United States Patent [19]

Rumsey, Jr.

[11] Patent Number: 4,469,193

[45] Date of Patent: Sep. 4, 1984

[54] UTILITY LADDER

[76] Inventor: Joseph F. Rumsey, Jr., 1140 NW. 63rd St., Oklahoma City, Okla. 73116

[21] Appl. No.: 479,153

[22] Filed: Mar. 28, 1983

[51] Int. Cl.[3] ..... E06C 1/36; E06C 1/38

[52] U.S. Cl. ..... 182/22; 182/107; 182/118; 182/185; 182/206

[58] Field of Search ..... 182/107, 108, 109, 119, 182/118, 21, 22, 23, 27, 178, 104, 206, 151, 185

[56] References Cited

U.S. PATENT DOCUMENTS 2,114,215 4/1938 Dietle ..... 182/178

3,476,211 11/1969 Cormier ..... 182/178

3,675,736 7/1972 Roggie ..... 182/119

*Primary Examiner*—Reinaldo P. Machado

*Attorney, Agent, or Firm*—William R. Laney

[57] ABSTRACT

A ladder which can be used as either an extension ladder or step ladder or stool, and which includes a pair of slidingly telescoping, selectively extendable ladder sections. An interconnecting pedestal subassembly is provided and is adapted for detachable engagement with the side rails of the ladder sections. The interconnecting pedestal subassembly can be interchangeably used to form a ground engaging braking skid or a window hook when secured to one or the other of the ladder sections.

5 Claims, 8 Drawing Figures

UTILITY LADDER

BACKGROUND OF THE INVENTION

1. Field of the Invention

This invention relates to utility ladders having various modes of usage.

2. Brief Description of the Prior Art

A number of types of utility ladders have previously been proposed, and several of these have been patented. The following prior art known to Applicant is related to the subject matter of the present invention.

Richards U.S. Pat. No. 2,350,129 discloses a ladder composed of multiple parts which can be used as an extension ladder or can be easily converted into a step ladder. The extension ladder is to some extent limited in the adjustability of its length to certain fixed increments.

Cormier U.S. Pat. No. 3,476,211 discloses another type of ladder which can be used either as an extension ladder or as a step ladder.

Couse U.S. Pat. No. 2,834,528 discloses a convertible ladder which can be utilized as an extension ladder or as a step ladder. The Couse convertible ladder includes a pair of curved elements which are inserted in side rails of one of the ladder sections and can be used to hook over a horizontally projecting ledge to help maintain the position of the ladder against the side of a building.

Morris U.S. Pat. No. 1,987,535 discloses a folding extensible ladder which can be folded into a flat status for transport and storage, or can be folded to an angulated position and used as a step ladder. When the ladder is folded to another position, it can be used as an extension ladder.

Another type of utility ladder which is similar in some respects to the present invention is that which is illustrated and described in Hughes U.S. Pat. No. 4,060,150. The Hughes patent discloses a ladder which can be extended in its length by joining several sections to each other in an interfitting telescoping relationship, and which can be provided with a bridging or pedestal element for joining several sections to each other to form a step ladder structure. The rails of one of the ladder sections can also be connected to hook-like appendages which will permit a section of the ladder carrying such appendages to be hooked over a horizontal pole or branch with the ladder section suspended from the hook elements.

Another type of utility ladder having telescoping ladder sections which can be joined by a pedestal element to form a step ladder arrangement is that which is depicted and described in Leavitt et al U.S. Pat. No. 2,900,041.

BRIEF DESCRIPTION OF THE PRESENT INVENTION

The present invention provides a utility ladder which is versatile in utilization, and can be employed in a number of different ways. The ladder is structurally strong and has a minimum number of separate substructural elements.

Broadly described, the utility ladder of the present invention includes a pair of slidingly engagable ladder elements which can be telescoped together and adjustably interlocked to selectively adjust the overall length of the ladder. The several sections of the ladder can be interconnected by a pedestal subassembly which is easily engaged with the rails of the ladder sections.

The pedestal subassembly includes, as a part of the structure, serrations or ridges along one side thereof which provide firm engagement with the earth or other soft surface when the pedestal subassembly is employed to support the ladder against a building. Alternatively, a plurality of elastomeric pads or strips are provided on the pedestal subassembly for preventing skidding of the ladder when it is supported on a wooden supporting surface, or smooth surfaced concrete. The pedestal subassembly is configured so that it can be used as a hook or retaining structure to suspend one of both ladder sections from a window sill, limb or similar supporting structure. The pedestal subassembly carries pairs of quick-opening latching dogs which automatically open to receive rungs carried by ladder sections engaged with the hollow legs forming a part of the pedestal subassembly.

The utility ladder of the invention, by reason of the described construction, can be employed as a conventional extension ladder having the pedestal subassembly forming an anti-skid and braking structure suppporting the base of the extension ladder, or it can be converted to a step ladder, or to a small saw horse-type platform.

An important object of the invention is to provide a utility ladder which can be used in a number of ways in varying work conditions.

A further object of the invention is to provide a utility ladder which is structurally strong, and is characterized by a long and trouble free operating life.

A further object of the invention is to provide a utility ladder which can be supported on various types of surfaces and extended to a substantial height without risk of the ladder skidding or sliding when it is used.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

FIG. 6 a perspective view showing the use of a part of the utility ladder as a step stool.

Figure 3:
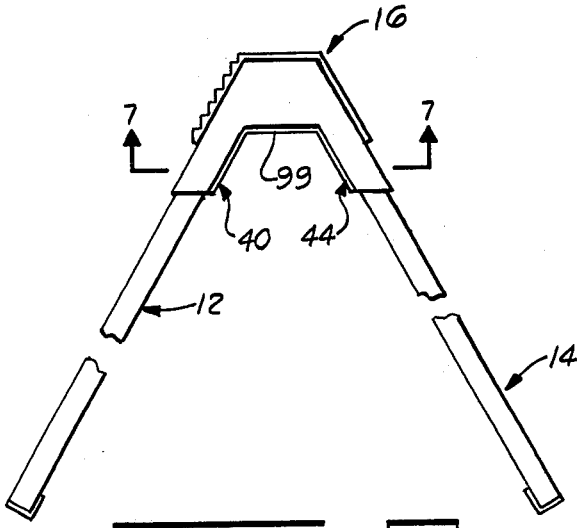
FIG. 3 is a side elevation view of the utility ladder of the invention set up for use as a step ladder.
Figure 7:
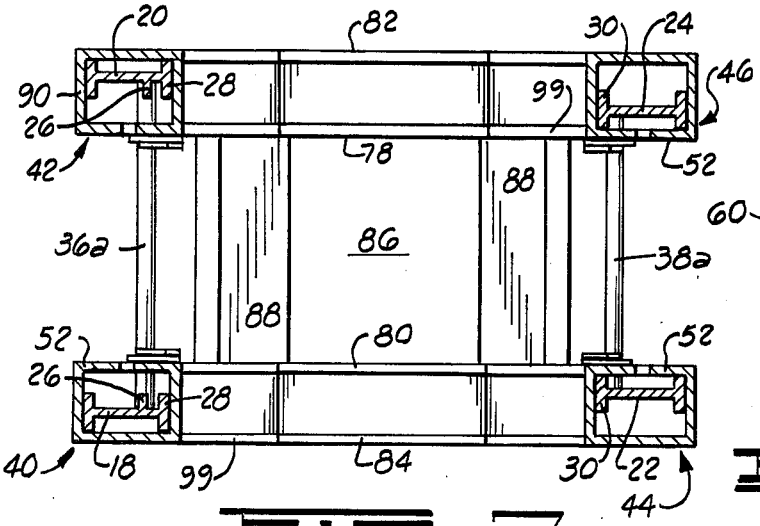

FIG. 7 is a sectional view taken along line 7—7 of FIG. 3.

Figure 8:
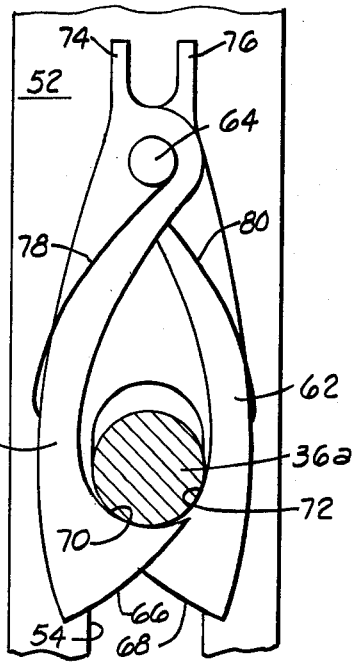

FIG. 8 is an enlarged detail view illustrating, partly in elevation and partly in section, a latching subassemably forming a part of the utility ladder of the invention.

DETAILED DESCRIPTION OF A PREFERRED EMBODIMENT OF THE INVENTION

Figure 1:
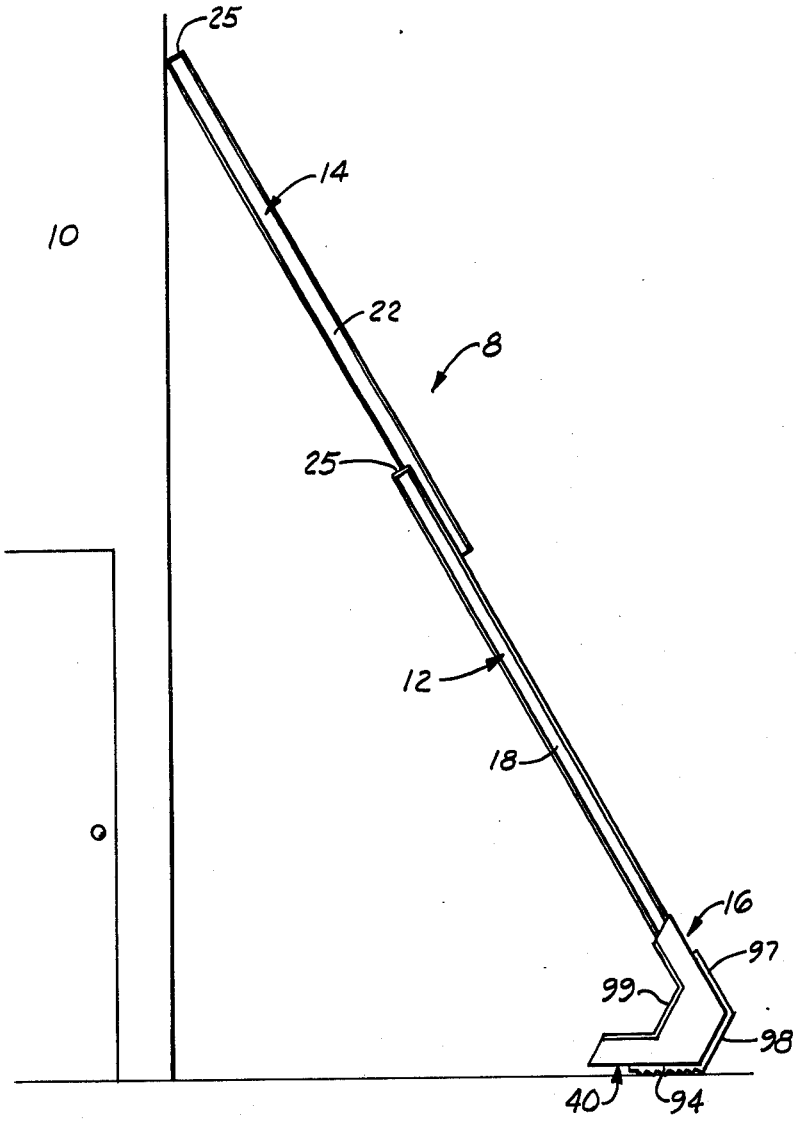
FIG. 1 is a side elevation view of a utility ladder constructed in accordance with the present invention, and showing the ladder as it is used as an extension ladder in position against the side of a building.
Figure 2:
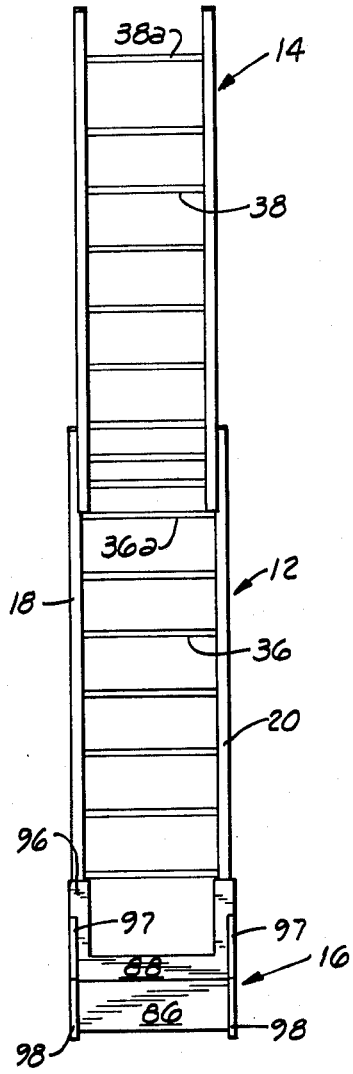
FIG. 2 is a front elevation view of the utility ladder.

Referring initially to FIG. 1 of the drawings, the utility ladder 8 of the invention is shown as it is supported against one side of a building 10 in position for utilization. The utility ladder includes a first or lower ladder section 12 and an upper ladder section 14. The lower ladder section 12 is slidably telescopingly interconnected to the upper ladder section 14 in a conventional manner, and this connection will subsequently be explained in greater detail. The lower ladder section 12 is shown extended into and connected to an interconnecting pedestal subassembly, designated generally by reference numeral 16. In the utility ladder of the invention, the first ladder section 12 is detachable from the second or upper ladder section 14, and each of these ladder sections can be used independently of the other.

Figure 4:
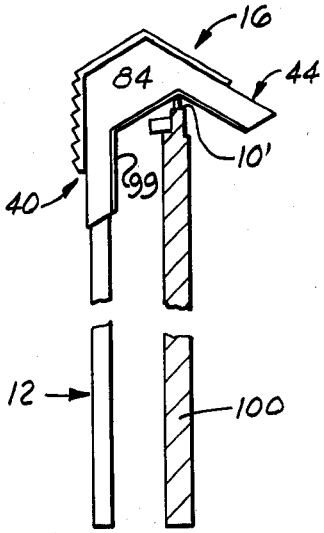
FIG. 4 is a side elevation view of the utility ladder constructed in accordance with the present invention, showing use of the same as a suspension ladder suspended from a window sill and alongside a building.

Each of the ladder sections 12 and 14 includes a pair of parallel, longitudinally extending side rails, and a plurality of spaced, parallel, transversely extending rungs or steps. The lower ladder section 12 thus includes parallel side rails 18 and 20. The upper ladder section 14 includes parallel side rails 22 and 24 as shown in FIG. 7. The side rails 22 and 24, 18 and 20 are generally of I-beam configuration, and each of them has an electrically non-conductive pad 25 at the opposite terminating ends thereof. Each of the rails 18 and 20 includes a pair of inwardly projecting parallel webs or flanges 26 and 28 carried on the side respective rail. These flanges 26 and 28 slidably receive and interfit with a flange 30 carried on each of the side rails 22 and 24 of the second or upper ladder section 14. In accordance with conventional extension ladder construction, the side rails of the ladder sections 12 and 14 carry latching elements (not shown) which permit the sections to be selectively lockably engaged to adjust the overall length of the ladder. Interconnecting the side rails 18 and 20 of the lower ladder section 12 are a plurality of parallel, transversely extending steps or rungs 36. Interconnecting the stiles or side rails 22 and 24 of the upper ladder section 14 are a plurality of steps or rungs 38. There are, as illustrated in FIG. 4, an upper step or rung **36*a* in the lower ladder section 12 and an upper or terminal rung or step 38*a* in the upper ladder section 14**.

A third major subpart of the utility ladder 8 of the invention is the interconnecting pedestal subassembly designated generally by reference numeral 16. The pedestal subassembly 16 includes a first pair of parallel legs 40 and 42, and also a second pair of parallel legs 44 and 46 which are divergent with respect to the pair of legs 40 and 42. Each of the legs 40–46 of the pedestal subassembly 16 is hollow or tubular, and all of them are of identical rectangular cross-section as best illustrated in FIG. 6. The legs 40–46 are each dimensioned to slidably receive therein, the side rails 18 and 20 of the first ladder section 12, and the side rails 22 and 24 of the second ladder section 14.

Each of the legs 40–46 of the pedestal subassembly 16 includes an inner side wall 52 which defines an axially projecting slot 54. It will be noted that the axially projecting slots 54 are each dimensioned to slidably receive the terminal rungs **36*a* and 38*a* which extend between the side rails 18 and 20, and 22 and 24, respectively, of the first ladder section 12 and second ladder section 14**, respectively.

A pair of cooperating latching dogs 60 and 62 is positioned at the axially inner end of each of the slots 54, and is pivotally secured to the respective side wall 52 of the hollow rectangularly cross-sectioned leg of the pedestal subassembly 16 in which the respective slots are located. Thus, for example, as illustrated in FIGS. 4 and 7, the leg 42 has secured to its inner side wall 52 at the terminus of the longitudinally extending slot 54, a pair of cooperating latching dogs 60 and 62. Each latching dog 60 and 62 is free to pivot about a pivot pin 64 by which the dogs are secured to the inner side wall 52 of the leg 42. At an end of each of the latching dogs 60 and 62 which is distal with respect to its end secured to the inner side wall 52 by the pivot pin 64, each of the latching dogs carries an arcuate, convex edge. Thus, the latching dog 60 carries a convex edge 66 and the latching dog 62 carries as arcuate, convex edge 68. Each of the latching dogs 60 and 62 also carries a concave internal locking surface or edge. This edge as carried by the dog 60 is visible in FIG. 8 of the drawings and is denominated by reference numeral 70. An identically shaped arcuate concave latching surface 72 or edge is carried on the latching arm 62.

The latching dogs 60 and 62 are each further provided with a pair of projecting releasing fingers 74 and 76 which, when pressed toward each other, cause the latching dogs 60 and 62 to pivot about the pivot pin 64 in a direction to open apart from each other, the free ends of the latching dogs which carry the convex edges 66 and 68 and the concave inner edges 70 and 72. A pair of wire springs 78 and 80 extend from a spring coil which surrounds the pivot pin 64, and are looped or hooked over the latching dogs 60 and 62 so as to apply constant resilient bias to the dogs 60 and 62 urging them toward each other at their ends which are distal with respect to the pivot pin 64.

The construction which has been described as characteristic of the latching dogs 60 and 62 pivotally mounted on the inner side wall 52 of the hollow leg 42 of the pedestal subassembly 16 is also characteristic of identically constructed pairs of latching dogs carried on the inwardly facing side walls 52 of each of the other hollow legs 40, 44 and 46 of the pedestal subassembly.

Figure 5:
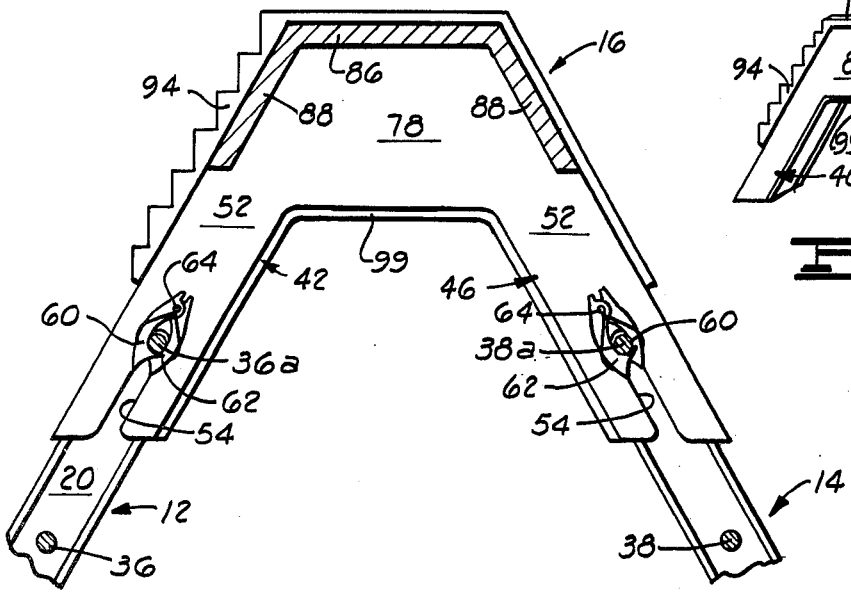
FIG. 5 is an enlarged sectional view, taken along line 5—5 of FIG. 6, of a portion of the utility ladder when the same is in a step ladder status.
Figure 5:
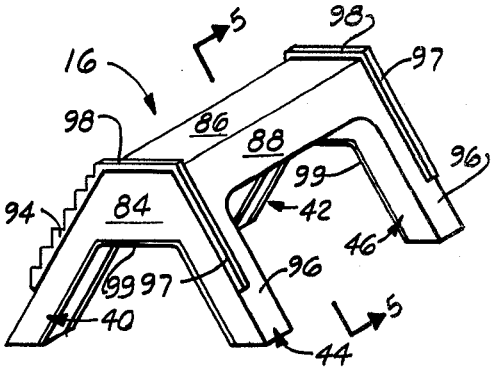

It will be noted that the hollow, rectangularly cross-sectioned legs 40–46 of the pedestal subassembly 16 are convergent near one end of the pedestal subassembly, and that the convergent legs 42 and 46, illustrated in FIG. 5 are interconnected by a trapezoidally-shaped inner side plate 78. A similar trapezoidally-shaped inner side plate 80 interconnects inwardly facing side walls 52 of the legs 40 and 44. The pairs of legs are also interconnected by outwardly facing trapezoidally-shaped outer side plates 82 and 84 as illustrated in FIG. 7. Projecting across the upper side of the pedestal subassembly 16 between the trapezoidally-shaped outer plates 82 and 84 is a flat step plate 86 (see FIGS. 5, 6 and 7). A pair of transverse plates 88 are joined at their upper edges to the step plate 86 and extend between respective pairs of legs 44 and 46, and 40 and 42, of the pedestal subassembly 16 as illustrated in FIGS. 4, 5 and 6.

Secured to forward side walls 90 of the legs 40 and 42, respectively, are a plurality of ribs stepped serrations 94 which may be generally described as hard or metallic in character and having ridge edges which face upwardly in the direction of the step plate 86 as illustrated in FIG. 5. The ribs or serrations 94 extend a major portion of the way across the forward side walls 90, and are preferably constructed of high strength, relatively hard metal. Extending upwardly along forward side walls 96 of the legs 44 and 46 of the pedestal subassembly 16 are a pair of substantially parallel strips 97 of elastomeric material. Similar strips 98 of elastomeric material extend parallel to each other across the upper surface of the step plate 86 adjacent the opposite ends thereof. On the inner sides of the legs 40, 42, 44 and 46 and across the lower edges of the outer side plates 82 and 84 a pair of electrically non-conductive, relatively thick strips 99 are secured as shown in FIGS. 3–7.

As previously stated, the utility ladder 11 of the invention is extremely versatile in its modes of usage, and can be employed in several ways. In FIG. 1 of the drawings the ladder is employed as an extension ladder. Here, as previously pointed out, the first ladder section 12 and the second ladder section 14 are slidably interconnected with suitable incremental locking elements in accordance with conventional extension ladder construction. Thus, the lower ladder section 12 can be pulled out in an axial direction from the upper ladder section 14 to extend the overall length of the utility ladder, and can then be locked at any selected overall length.

When the ladder is used as an extension ladder in the manner described, the interconnecting pedestal subassembly 16 is used as a braking or anti-skid structure at the lower end of the ladder. In order to enable the pedestal subassembly 16 to function in this fashion, the pedestal subassembly is constructed so that the side rails 18 and 20 of the first ladder section may be telescoped into either the legs 40 and 42 of the pedestal subassembly, or into the legs 44 and 46. The same capability is true of the side rails 22 and 24 of the second ladder section 14. The purpose of this arrangement will be hereinafter described.

As the side rails 18 and 20 of the ladder section 12 are telescoped into the legs 40 and 42 in the manner illustrated in FIG. 1, the angulation which characterizes the free ends of the divergent legs pairs 40–44 and 42–46 of the pedestal subassembly 16 permits the legs 40 and 42 to extend substantially horizontally along the ground, with the forward side walls 90 facing downwardly toward the ground. This arrangement brings the ridges 94 into contact with the supporting surface. The pedestal subassembly 16 is utilized in this manner when the ladder is to be used as an extension ladder, and is to be supported upon the ground or a relatively soft, slippery surface. The ridges or serrations 94 carried on the legs 40 and 42 face downwardly toward, and bite into, the earth to prevent the ladder from slipping or skidding. This arrangement also provides broad support and prevents the ladder rails from sinking into soft earth.

If, instead of supporting the extension ladder 8 upon the ground the ladder is to be supported upon a wooden or concrete surface, then the interconnecting pedestal subassembly 16 is reversed so that the rails 18 and 20 of the first ladder section 12 extend into the legs 40 and 42 of the pedestal subassembly. Where this is the arrangement, the legs 44 and 46 then extend along the hard surface. The coefficient of friction between the strips of elastomeric material 97 and such hard surface will prevent the ladder from skidding outwardly and enhance the safety with which it may be used. It can also be extended at a relatively larger angle to the building by reason of this construction.

At this point, it should be noted that the anti-skid utilization of the pedestal subassembly 16 in precisely the same manner which has been described can be advantageously employed whether the first ladder section 12 or the second ladder section 14 has been telescopingly engaged with the pedestal subassembly. It will be recalled that the cross-sectional configuration of each of the legs 40–46 of the pedestal subassembly is such that the rails 22 and 24 of the ladder section 14 can be telescoped into these hollow legs, as can the rails 18 and 20 of the first ladder section 12. This versatility provides a significant advantage where there is no need to use a heavy extension ladder to reach to a substantial height on the side of the building, yet the type of supporting surface upon which one of the ladder sections is to be supported is such that special traction needs to be developed beyond that which would be afforded by only the lower ends of the side rails of the two ladder sections. In such case, the pedestal subassembly 16 affords a very safe support for whichever of the ladder sections 12 or 14 is to be employed.

In another mode of utilizing the utility ladder 8 of the invention, the structure can be converted from an extension ladder of the sort shown in FIG. 1 to a step ladder of the type portrayed in FIG. 3. Where the utility ladder of the invention is to be employed in step ladder form, the side rails 18 and 20 of the ladder section 12 are placed into one of the leg pairs 40 and 42, and the ladder section 14 is telescopingly engaged with the pedestal subassembly by sliding insertion of the side rails 22 and 24 thereof into the hollow legs 44 and 46 of the pedestal subassembly 16.

The pedestal subassembly 16 is a strong structural element which forms a rigid interconnecting structure between ladder sections 12 and 14, and will maintain the step ladder configuration under very substantial loads. The distance which the side rails of the respective ladder sections 12 and 14 can slide into the hollow legs 40–46 of the pedestal subassembly 16 is limited by the step plate 86, and just prior to the time that the side rails reach this limit of travel, the uppermost rungs **36*a* and 38*a* of the two ladder sections are engaged by the paired latching dogs 60 and 62 located on the inner side walls 52 of the several legs 40–46. The latching dogs 60 and 62 are positioned to first be biased apart to admit the top rungs 36*a* and 38*a*** of the ladder sections, and to then spring back into position to interlock the top rungs against release by downward movement of the side rails between which these rungs are connected in the respective ladder sections.

Engagement of the uppermost ladder rungs **36*a* and 38*a* by the pairs of latching dogs 60 and 62 is particularly important in a third mode of usage of the utility ladder of the invention illustrated in FIG. 4. Here it will be noted that the ladder section 12 has been suspended along a building wall 100 from a window sill 101 by means of the pedestal subassembly 16 which is connected to the upper end of this ladder section. This capability of the utility ladder 8 is particularly important in situations such as a necessitated hurried descent from inside a building, or where there is inadequate room to extend the ladder base outwardly from the building in the manner shown in FIG. 1. It should be pointed out that the ladder can also be used in the manner shown in FIG. 4 but with both the two ladder sections 12 and 14 interconnected to each other in the telescopingly engaged fashion depicted in FIG. 1, still employing the pedestal subassembly 16 as a hook by which the utility ladder is hung or suspended from a window sill. Since there may be occasions where this mode of usage of the ladder will cause some risk of exposure to injurious electrical shock due to the presence of an exposed electrical conductor adjacent the pedestal subassembly, the nonconductive strips 99** are provided to minimize this risk.

Yet another way in which the utility ladder 8 of the invention can be utilized is illustrated in FIG. 6 of the drawings. Here the pedestal subassembly 16 is itself utilized as a step stool or even as a low saw horse. The angles at which the free ends of the several hollow or tubular legs 40–46 are cut across permit these legs to rest flush on the floor or other supporting surface. In this position, the step plate 86 affords a horizontal, upwardly facing surface which can function as a seat, or as a rest for a timber, can of paint or other article which needs to be supported at some relatively low height above a supporting surface.

From the foregoing description of the invention, it will be apparent that the utility ladder herein described affords a versatile and useful tool for employment in several widely different situations where different types of ladders or supporting structures are needed. Although a preferred embodiment of the invention has been herein described and illustrated, it will be understood that various changes and innovations in the illustrated and described structures can be effected without departure from the basic principles of the invention, and such changes and innovations are deemed to be circumscribed by the spirit and scope of the invention except as the same are necessarily limited by the claims appended hereto, or reasonable equivalents thereof.

What is claimed is:

1. The utility ladder comprising:

a pair of slidingly engaged ladder sections each including:

a pair of spaced, parallel rails; and a plurality of spaced, parallel, transverse rungs engaging the parallel rails; and an interconnecting pedestal subassembly which comprises:

a first pair of spaced, parallel hollow legs adapted to slidingly engage the spaced parallel rails of either of said ladder sections;

a second pair of spaced, parallel hollows legs convergent with respect to said pair of parallel legs and adapted to slidingly engage the spaced parallel rails of either of said ladder sections;

rigid ribs on the outer side of each of the legs in one of said leg pairs and adapted and positioned for engagement with a horizontal supporting surface when said legs in the other said leg pairs engage and support the side rails in one of said ladder sections, and the legs in the in said one leg pair extend horizontally along said supporting surface; and elastomeric strips on the outer side of each of the legs in said other of said legs pairs and adapted and positioned for engagement with the horizontal supporting surface when said legs in said one leg pair engage and support the side rails of one of said ladder sections, and the legs in the other of said pair of legs extend horizontally along said supporting surface; and a step plate extending across and interconnecting the convergent ends of the first and second pairs of parallel legs.

2. A utility ladder comprising:

a pair of slidingly engaged ladder sections each including:

a pair of spaced parallel rails; and a plurality of spaced, parallel, transverse rungs interconnecting the parallel rails; and an interconnecting pedestal subassembly which comprises:

a first pair of spaced, parallel hollows legs adapted to slidingly engage the spaced parallel rails of either of said ladder sections; and a second pair of spaced, parallel hollow legs convergent with respect to said first pair of parallel legs and adapted to slidingly engage the spaced parallel rails of either of said ladder sections;

wherein each of said legs is of rectangular cross-section and comprises:

an inner side wall defining a rung-receiving slot;

an outer side wall extending parallel to said inner side wall;

a front wall; and a back wall extending parallel to said front wall;

a step plate extending across and interconnecting the convergent ends of said first and second pairs of parallel legs;

a pair of cooperating latching dogs pivotally secured to the inner side wall of each of said legs adjacent said rung-receiving slot and adapted to admit between the latching dogs, and to engage, a rung of one of said ladder sections; and means resiliently biasing said latching dogs to a convergent latching position.

3. A utility ladder as defined in claim 2 and further characterized as including:

a plurality of protuberant ribs mounted on, and projecting outwardly from, the front walls of the legs in one of said pairs of legs for resisting skidding of the ladder when supported on said legs in said one leg pair; and elastomeric bodies mounted on the front walls of the legs of said other leg pair for resisting skidding of the ladder when supported on the legs in said other pair of legs.

4. A utility ladder as defined in claim 3 wherein said pedestal subassembly further includes a pair of outer side plates extending between and interconnecting the legs of said pedestal subassembly; and a pair of inner side plates extending between and interconnecting the legs of said pedestal subassembly and extending parallel to said outer side plates.

5. A utility ladder comprising:

a pair of slidingly engaged ladder sections each including:

a pair of spaced, parallel rails; and a plurality of spaced, parallel, transverse rungs interconnecting the parallel rails; and an interconnecting pedestal subassembly which comprises:

a first pair of spaced, parallel hollows legs adapted to slidingly engage the spaced parallel rails of either of said ladder sections;

a second pair of spaced, parallel hollow legs convergent with respect to said first pair of parallel legs and adapted to slidingly engage the spaced parallel rails of either said ladder sections; and wherein each of said legs is of rectangular cross-section and comprises:

an inner side wall defining a rung-receiving slot;

an outer side wall extending parallel to said inner side wall;

a front wall; and a back wall extending parallel to said front wall;

a step plate extending across and interconnecting the convergent ends of said first and second pairs of parallel legs; and means secured to the inner side wall of said legs and adapted for detachably engaging the rails of said ladder sections when said ladder section rails are slidingly received within the pairs of legs of said interconnecting pedestal subassembly.

* * * * *